US005433279A

United States Patent [19]

Tessari et al.

[11] Patent Number: 5,433,279

[45] Date of Patent: Jul. 18, 1995

[54] PORTABLE TOP DRIVE ASSEMBLY

[76] Inventors: Robert M. Tessari, Box 43, Site 19, S.S. 1, Calgary, Alberta, Canada, T2M 4N3; Per Angman, #6 Granville Crescent S.W., Calgary, Alberta, Canada, T3E 4E2

[21] Appl. No.: 93,721

[22] Filed: Jul. 20, 1993

[51] Int. Cl.[6] ..... E21C 5/06

[52] U.S. Cl. ..... 173/213; 173/147; 173/151

[58] Field of Search ..... 173/147, 145, 151, 141, 173/213

*Primary Examiner*—Rinaldi I. Rada

*Attorney, Agent, or Firm*—Terry M. Gernstein

[57] ABSTRACT

The assembly is designed to convert a conventional land rig to "top drive". It comprises a torque track that is shipped in sections and is assembled to form a rigid track extending vertically in the derrick. The track is rigidly attached to the derrick only at its base, so that the track is free to twist and deflect laterally along its length. The housing of the top drive is connected by an angled, pivotally mounted link means with a tubular bushing that embraces and slides along the track. The link means and bushing are adapted to restrain rotation of the housing relative to the track, while transmitting both side and torque reactive loads to the track. The angled pivoting link enables the top drive to be displaced outwardly to a position over the mousehole. The top drive incorporates a hydraulic motor and gear drive assembly for rotating a drive shaft connecting the drill string and hoisting means. The housing does not carry the drill string load and can be made lighter and more compact as a result.

9 Claims, 14 Drawing Sheets

PORTABLE TOP DRIVE ASSEMBLY

FIELD OF THE INVENTION

This invention relates to a top drive assembly for use in rotating the drill string of an oilfield drilling rig.

BACKGROUND OF THE INVENTION

It has previously been common in well drilling to impart rotational drilling or hoisting forces to a drill string using a top drive unit mounted to a guide track extending upwardly within a rig derrick. These top drive units use either electric or hydraulic power. The units are generally large and are designed primarily for offshore rigs, although they have been installed in land rigs.

In prior applications, the rig derrick has had to be modified to some degree, usually through welding, to be able to accept the size of the machine, the track on which the top drive unit travels, and to be able to accept the torque imparted to the derrick from the top drive unit through the track. In some installations, the derrick has had to be extended to accommodate the top drive unit. In most cases, the rig's travelling blocks and/or rotary drilling swivel have had to be replaced or modified in order to work with the top drive unit.

Top drive implementation requires a reactive torque absorbing means. This is provided by a vertical guide track or a tensioned cable secured to the derrick. The tensioned cable puts high vertical loads on the derrick, forcing a deration of the hook load capacity. Guide tracks have generally been secured to the derrick in a manner such that significant reactive torque is transmitted to the derrick structure along its length, which has generally been designed for heavy vertical and only nominal torque loads; this has required structural modifications to compensate.

One type of reactive torque absorbing means that has been used specifically to reduce reactive torque loads on the derrick is disclosed in U.S. Pat. No. 2,998,084, issued to Johnson et al. This patent teaches a top drive and track having an interconnecting pivoting linkage apparatus. The linkage pivots about vertical axes; it is unable to transfer side loading and transmits pure rotational reactive torque into a torque track. The track is rigidly secured near its base to the rig, transferring torque loads thereinto.

The hereinabove described linkage type and other top drive and track assemblies require substantial distance between the track and the top drive to accommodate either the various interconnecting means or the large physical size of the drive mechanism. Clearance restrictions exist between the inside back of the derrick and the wellbore center. This limits the application of the apparatus of the prior art to a small number of derricks having large clearances.

Although an increasing number of land rigs are being manufactured or modified to accept conventional top drive units, to date all top drive installations described in the published prior art have been permanent, to the best of applicant's knowledge. Because of the physical and mechanical limitations of the top drive systems described in the prior art, a top drive drilling system has not been available on an economical and temporary basis for the vast majority of land drilling rigs and a substantially lesser number of offshore drilling rigs.

As stated, use of conventional top drives requires substantial modifications to the rig. Generally, modifications to a derrick will require structural re-certification. Modifications are time consuming and expensive, and are not usually undertaken for a temporary installation. With all the top drives described in the prior art, the purchase cost of a top drive for a permanent installation in most rigs is not economically justifiable when compared to conventional rotary drilling equipment used in the same drilling application on a competitive basis.

With this background in mind, it was the objective of the present invention to provide a compact, portable top drive system that could be temporarily installed in existing drilling rigs without structural modifications and without derating the derrick capacity.

SUMMARY OF THE INVENTION

In designing and testing prototypes of the invention, it was concluded:

- that a top drive unit needed to be compact in order to fit within the wide range of derrick types;
- that, while compact, the system needed to operate with as high a drilling torque capacity as one could manage;
- that there was a need to avoid transferring torque loads into the relatively weak upper derrick structure;
- that there was a need to minimize adding vertical loads to the derrick, to avoid deration of the hook load capacity;
- that there was a need for a torque track that could be easily installed on a temporary basis in a derrick, without modification of the derrick;
- that it was desirable to improve pipe-handling capability for the top drive system;
- that it was desirable to provide an independent power supply for the top drive, so that the top drive could be incorporated without concern for the nature of the rig's power supply; and
- that there was a need to so integrate the new top drive system with an existing rig as to enable quick conversion to top drive and quick return to conventional rotary table operation, while still providing a portable system.

With these objectives in mind, an assembly was developed for transmitting reactive torque loads from a top drive unit ("top drive") to a rig in whose derrick the top drive is suspended.

The assembly comprises a linearly extending, unitary, substantially rigid, segmented torque track. The track is mounted so as to extend vertically in the derrick along the major part of the latter's length. The track is parallel with and laterally offset from the wellbore, to allow the top drive and hoisting means to travel vertically in the derrick.

The track is formed of a plurality of sections which are disengagably and rigidly joined end to end by suitable means. The sections can thus be assembled section by section in the derrick to create the unitary track. The track can be disassembled when desired into easily transportable sections.

The track is rigidly and disengagably secured by connection means, located at its base, with the rig. More particularly, a torque beam and clamps can be used to secure the track rigidly to the lower, robust end of the derrick. The connection means serve to hold the track vertically in the derrick and transmit reactive loads from the track to the rig. The track is otherwise free of rigid connection with the derrick. Therefore it can twist axially or deflect laterally if sufficiently loaded.

A tubular torque bushing rigidly engages the track. This bushing is adapted to slide longitudinally along the track but it cannot rotate thereon. More particularly, the track is preferably of box section and so is the bushing. The latter is slid over the latter to lock them together and prevent relative rotational movement. This rigid lock up of the bushing and track ensures that reactive loads applied to the bushing are transmitted to the track.

Linking means are provided which connect the top drive housing and the bushing. The linking means function to rigidly restrain the housing against rotation by tying it to the bushing and track. Preferably, the linking means is a rigid, elongate torque frame, pivotally connected at its ends with the housing and bushing, so that it can pivot about horizontal axes (but not vertical axes). The linking means can be said to be "rotationally rigid". Preferably the linking means is angularly disposed between bushing and housing, so that it will accommodate lateral displacement of the latter away from the track, for a purpose to be described.

The assembly as described embodies certain essential features that are novel in combination. More particularly:

- the linking assembly, consisting of torque frame and torque bushing, is adapted to transmit both the torque and side reactive loads or forces generated in the top drive housing, to the track; and
- the track is rigidly tied to the rig only at the base of the track. Thus, reactive loads are not transmitted to the upper reaches of the derrick. It is our belief that the side loads are small and they are converted into torque loads in the track. The free-to-twist track column transmits all of these torque loads downwardly to the bottom connection, for transmittal into the rig structure.

This structural arrangement has enabled use of a relatively slender and light track, which lends itself to portability.

In a preferred aspect, a plurality of hydraulic motors are coupled through gear means to rotate a vertical drive shaft assembly that connects the drill string with the swivel and hoisting means. This design solves a shortcoming of some prior art top drives, which connect the drill string with the swivel and hoisting means through a stout housing. The housing can now be lighter. Also the hydraulic motor and gear assembly is compact in comparison to prior art electric power systems.

In another preferred aspect, a separate portable hydraulic power unit is used to power the top drive and its components, rather than utilizing the rig's power means. The power unit supplies hydraulic fluid to the top drive motors through a clad bundle of hoses suspended from the derrick.

In another preferred aspect, the bales and elevator of the top drive are pivotally suspended from a collar carried by the lower end of the drive shaft assembly. Linearly extendable means (e.g. cylinders) are pivotally connected at their rear ends to the rear portion of the top drive housing and at their front ends to the bales, for rotating the bales and elevator forwardly into a horizontal plane. This enables the top drive to be set down on the rig floor, which assists in disassembly.

In another preferred aspect, the pivotally connected torque frame is coupled with pivotally mounted cylinders connected between the bushing and the housing. This arrangement enables the top drive to be laterally displaced. In this way, the top drive can make connections in the "mousehole" of the rig.

Broadly stated, the invention relates to a portable top drive assembly for use with a drilling rig having a base (comprising the rig sub-structure and the robust lower end of the derrick), said rig further having an upstanding derrick operatively aligned over a wellbore, said derrick supporting hoisting means, a swivel and a drill string extending into the wellbore, said top drive assembly comprising: a top drive unit comprising a housing, a drive assembly supported by the housing, and a tubular drive shaft assembly extending vertically through the housing and being connected with the drive assembly for rotation thereby, said drive shaft assembly having upper and lower ends and being connected at its lower end with the drill string and at its upper end with the swivel for suspension from the derrick by the hoisting means; the top drive unit housing being subjected to reactive side and torque loads when the drive shaft rotates the drill string; and apparatus for transmitting the reactive loads from the housing to the rig comprising a linearly extending, substantially rigid torque track extending vertically in the derrick along the major part of the derrick's length, said track having upper and lower ends, said track being parallel with and laterally offset from the wellbore, said track being formed of sections joined end to end, means for disengagably and rigidly connecting the track sections end to end, means for rigidly connecting the track at its lower end with the base of the rig so that reactive loads applied to the track are transmitted therethrough to the rig and so that the track is held upright in the derrick, the track otherwise being free of rigid connection with the derrick so that it can twist axially and deflect laterally relative to the derrick, a torque bushing rigidly engaging the track so that it can slide therealong but cannot rotate thereon, said bushing being operative to transmit reactive loads applied to it to the track, and linking means, connecting the housing and the bushing, for rigidly restraining the housing against rotation relative to the bushing and track and for transmitting reactive side and torque loads from the housing to the track.

DETAILED DESCRIPTION OF THE PREFERRED EMBODIMENT

Figure 1:
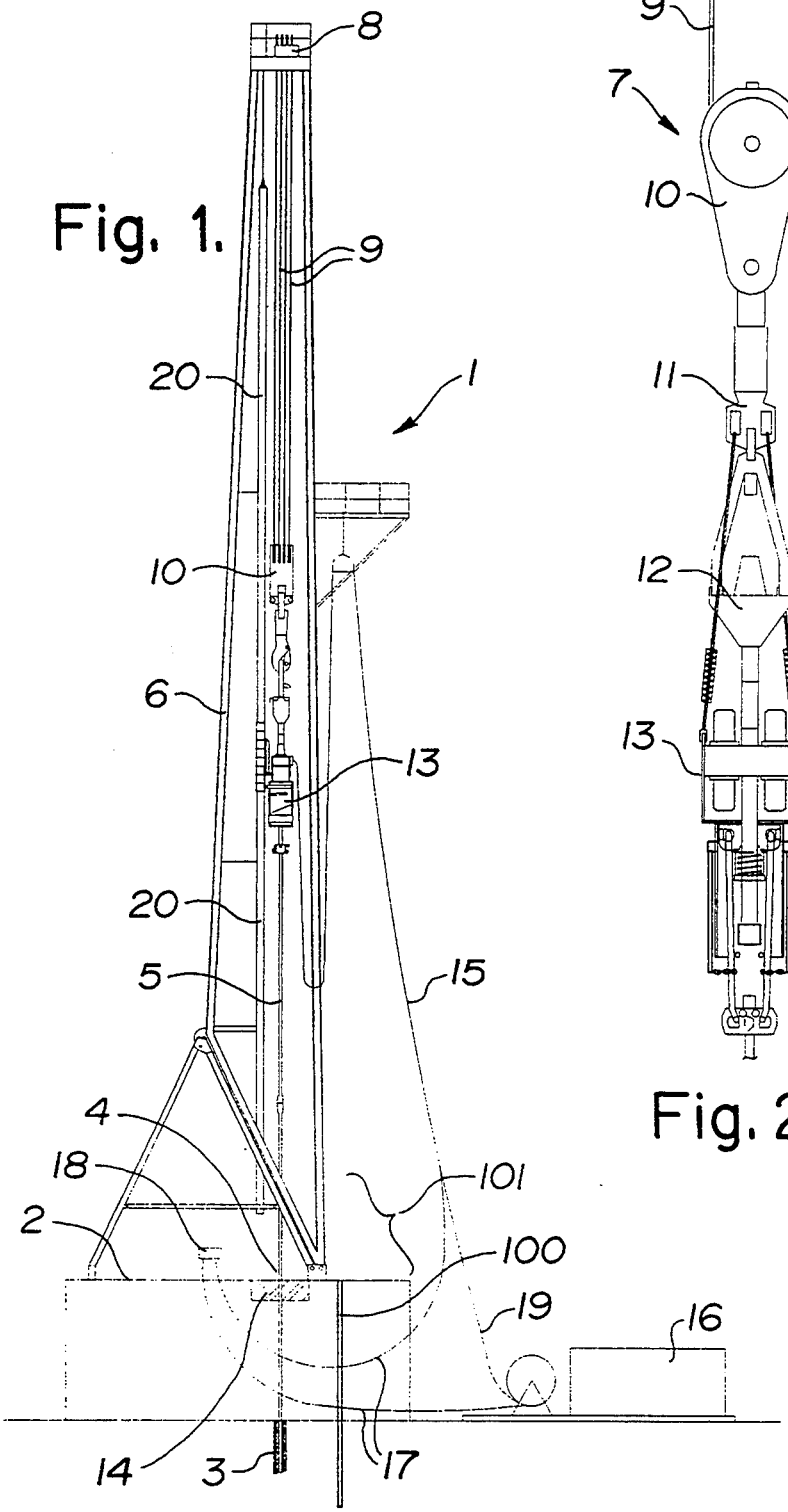
FIG. 1 provides a simplified side view of a conventional land drilling rig having the portable top drive system installed.
Figure 2:
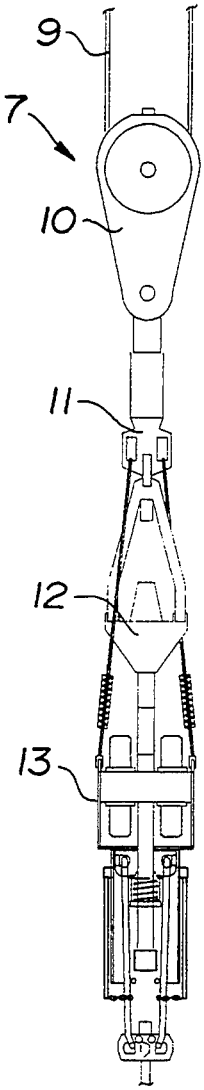
FIG. 2 is a front view showing the top drive unit (some detail omitted) suspended from a rig hoisting assembly.
Figure 3:
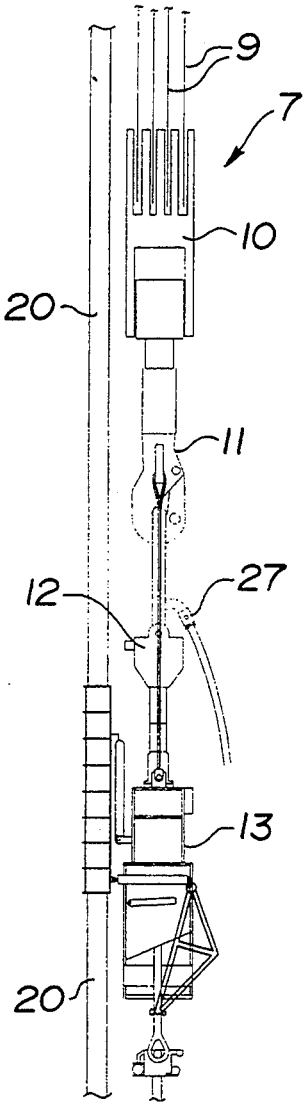
FIG. 3 is a side view of the top drive unit shown in FIG. 2.

The present invention provides an improved portable top drive system for converting conventional kelly and rotary table drilling rigs to top drive. As illustrated in FIG. 1, a conventional rig 1 has a rig sub-structure 2 positioned over a wellbore 3. The sub-structure 2 has an opening 4 through which a drill string 5 may extend downwards into the wellbore 3. The sub-structure 2 also usually has a mousehole opening 100 for use in making connections. A derrick 6 stands above the rig sub-structure 2, operatively aligned relative to the wellbore 3, to support the drill string 5 from hoisting means 7 shown in FIGS. 2 and 3. The hoisting means 7 comprises a crown block 8, cables 9, travelling block 10 and hook 11 and suspends a swivel 12. Access to the rig is provided through a V-door opening 101 in one side of the derrick 6.

A top drive unit 13 replaces a conventional elevator and is suspended from the swivel 12. The swivel 12 is in turn suspended from the travelling block 10 and hook 11, which may lift and lower the top drive unit 13 in the derrick 6. The drill string 5 is suspended from the top drive unit 13. Drilling rotation is imparted to the drill string 5 by the top drive unit 13.

The top drive unit 13 is hydraulically powered and is supplied with actuating fluid via hoses contained within a clad hose bundle 15 extending from a portable power unit 16. Control air and hydraulic lines 17, extending from a control panel 18, and power hydraulic lines 19 are both provided within the hose bundle 15. The hose bundle 15 is suspended from the derrick 6 to permit free travel of the bundle throughout the range of top drive motion.

The control panel 18 is located on the rig floor 2 and provides a combination of hydraulic, air and electric control of top drive rotational speed (rpm), direction of rotation, pipe handling and other features disclosed later in the description. The control panel 18 also provides rpm limit and torque limit controls for avoiding situations such as over-speed in case of drill string failure and over-torquing of joints. The control panel may be disconnected from the air, electric and hydraulic lines 17 with quick connectors for shipping. The specific componentry referred to in the preceding two paragraphs is conventional and will not be described in detail.

Figure 4:
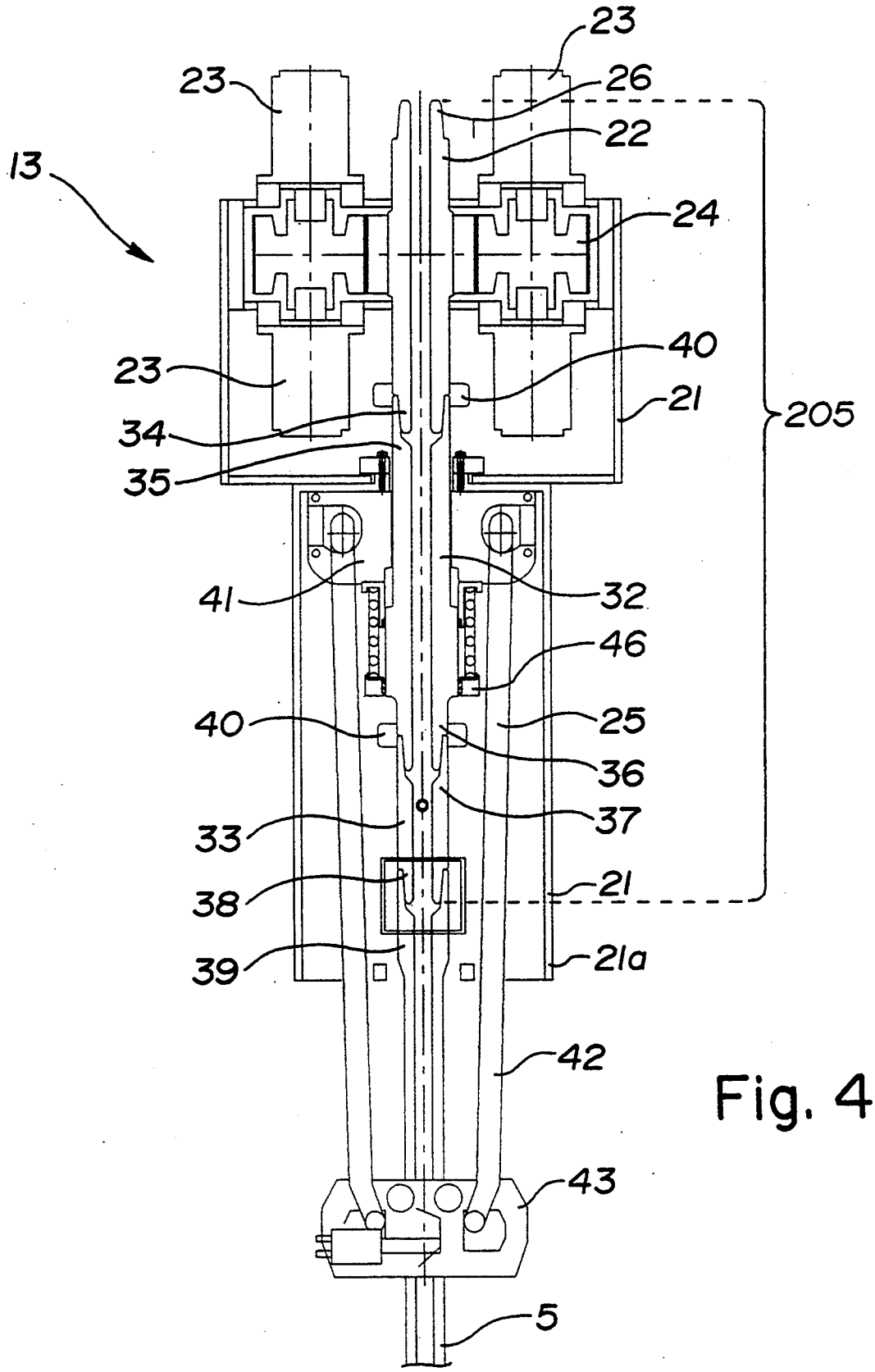
FIG. 4 is a front sectional view of the top drive unit as sectioned through its drive shaft axis.
Figure 5:
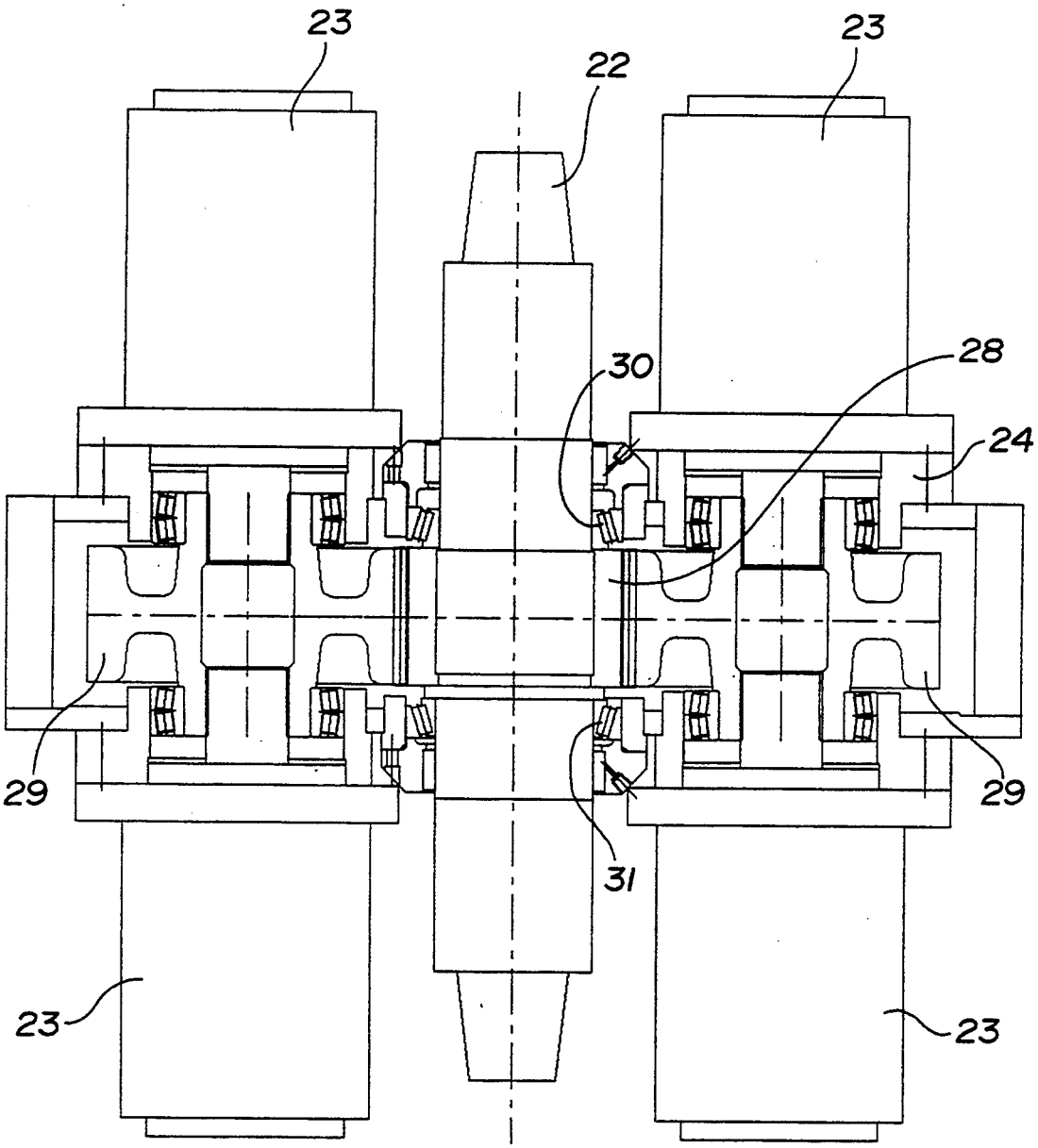
FIG. 5 is a detail sectional view of the gearbox and drive shaft of FIG. 4.

Referring to FIGS. 4 and 5, the top drive unit 13 comprises a structural housing 21, within which is positioned a tubular drive shaft 22, hydraulic drive motors 23, and an oil bath gearbox 24. The centrally located drive shaft 22 is vertically oriented and is adapted at its upper end 26 to thread into the swivel 12, typically by threaded means directly or by an adapter shaft (not shown). The hollow drive shaft 22 can transport drilling fluids introduced through a fluid coupling 27 forming part of the swivel 12. Better viewed in FIG. 5, the drive shaft 22 projects through the gearbox 24 and is fitted with an external main gear 28. Four bi-directional rotary hydraulic vane motors 23 are mounted to the gearbox 24, parallel to and offset from the drive shaft 22, to rotationally drive pinion gears 29 which mesh with the main gear 28, imparting the required rotational torque. Low speed vane motors 23 are used to produce high torque at low speed without the need for large, speed reducing gearboxes and their associated bulk weight; this results in a more compact, lighter top drive unit.

The housing 21 employs upper and lower thrust bearings 30, 31 on the drive shaft 22 to transmit the weight of the top drive unit 13, and it's associated, attached components, to the drive shaft 22 and thus to the hoisting means 7.

Referring to FIG. 4, the drive shaft 22 supports the drill string 5 through intermediary shafts comprising a load collar sub 32 and a kelly saver sub 33. Together they make up a drive shaft assembly. A kelly cock may be optionally included in combination with the saver sub 33. The lower end connection 38 of the saver sub 33 is adapted to thread into the upper end connection 39 of the drill string 5 in use. The saver sub lower end connection 38 is regularly connected and disconnected from the upper end connection 39 of the drill string 5 during rig operation. The hoisting loads of the drill string 5 are transferred through the saver sub 33, the load collar sub 32 and the drive shaft 22 to the hoisting means 7, avoiding loading of the top drive housing 21. This enables use of a compact housing 21.

To prevent the drive shaft-to-load collar sub threaded connections 34, 35 and the load collar sub-to-saver sub threaded connections 36, 37 from unthreading during operation of the top drive, locking clamps 40 are used.

It is desirable to suspend the weight of the pipe handling assembly 25 from the drive shaft assembly 205 and hoisting means 7 when the assembly 25 is carrying the weight of drill pipe. If this is accomplished, then the weight and size of the top drive housing 21 can be reduced, contributing to portability. The present assembly is therefore designed to suspend the pipe handling assembly 25 from the housing 21 when its weight is below a predetermined amount and to transfer the load to the drive shaft assembly 205 when the load is increased by picking up drill string.

More particularly, having reference to FIGS. 4 and 6–9, the pipe handling assembly 25 comprises a load collar 41, elevator bales 42 and an elevator 43. The bales 42 are pivotally suspended at their upper ends from the load collar 41 and the elevator 43 is pivotally suspended from the lower ends. All three components are conventional in their structure.

The housing 21 has a hollow, cylindrical lower section 21*a*. A pair of parallel bars 46 are attached to the sidewall of lower section 21*a* and extend horizontally on each side of the load collar sub 32.

A cylindrical spring 45 is supported at its lower end by the bars 46 and encircles the load collar sub 32 and extends vertically along part of its length. At its upper end, the spring 45 is received by a ring 45*a* which supports the load collar 41.

The load collar 41 is annular and forms an internal bore 47. It is mounted around the load collar sub 32.

The load collar sub 32 has an enlarged diameter or upset portion 48 adjacent its lower end. The horizontal bars 46 are located at the base of this upset portion 48.

The load collar 41 has a recessed load face 49 at its lower end.

Figure 6:
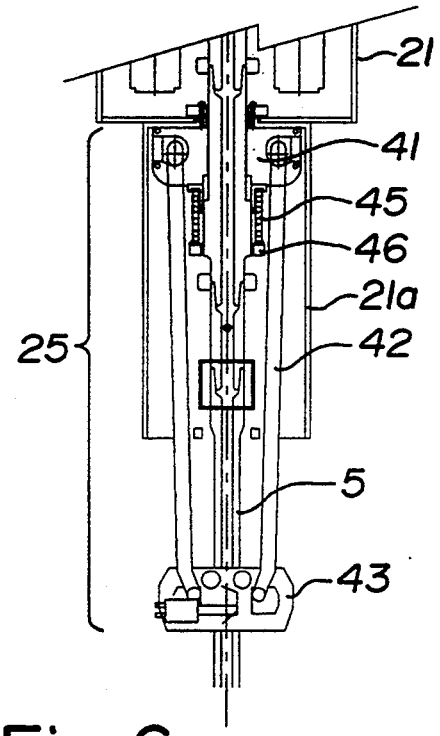
FIG. 6 is a partial front view of the top drive unit, detailing the pipe handling assembly in an unloaded state.
Figure 7:
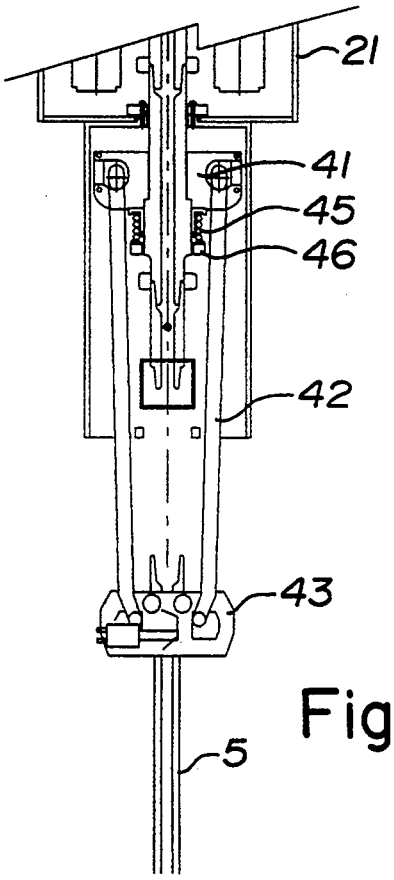
FIG. 7 is a front view of the pipe handling assembly of FIG. 6 in the loaded state.
Figure 8:
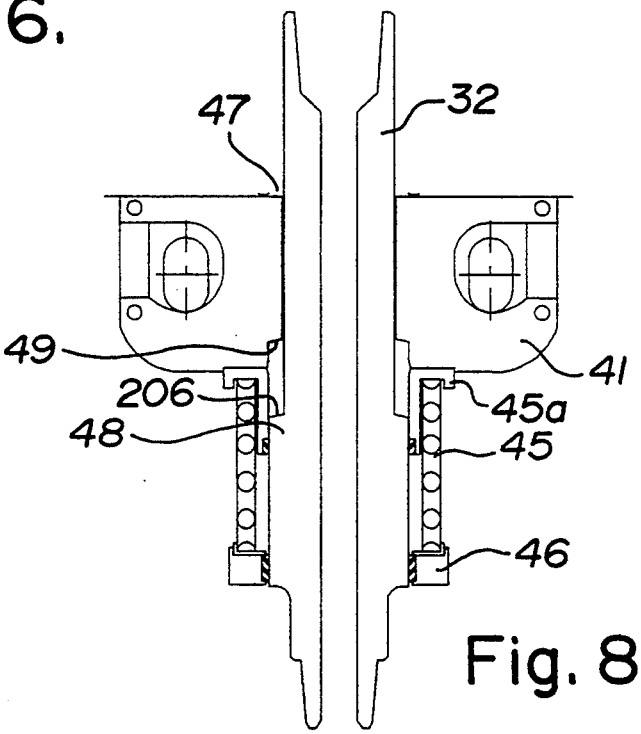
FIG. 8 is an enlarged front view of the load collar and load collar sub of FIGS. 6 and 7.
Figure 10:
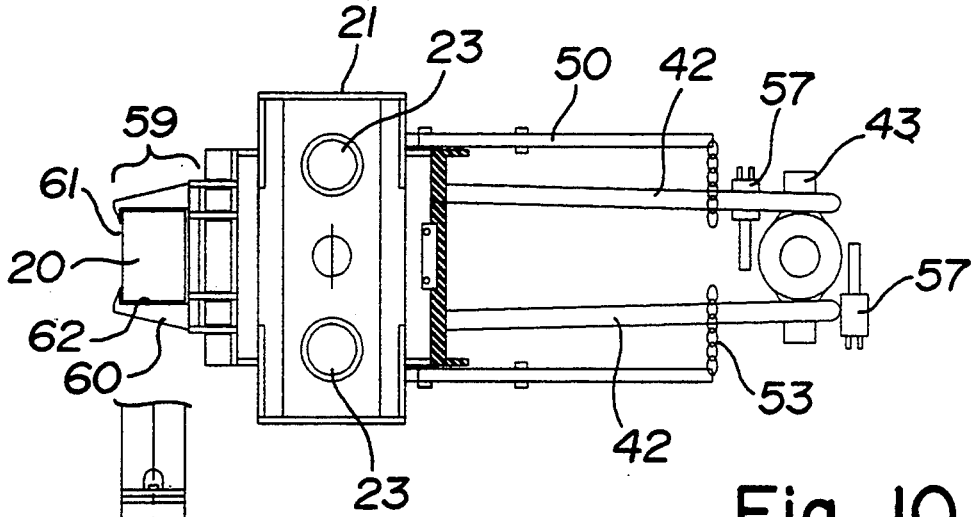
FIG. 10 is a top view of the top drive system, including the tilted bales and elevators.

If the spring 45 is fully expanded, it supports the load collar 41 in an upraised position, as shown in FIG. 6. In this position, the load face 49 is spaced above the upper end face 206 of the upset portion 48. However, the load collar 41 can slide downwardly along the sub 32 if the resistance of spring 45 is overcome. This downward travel by the load collar 41 is terminated when its load face 49 contacts the end face 206 of the upset portion 48. When the spring 45 is compressed in this manner and the faces 49, 206 are in contact, the load collar 41 is in an engaged position with the drive shaft assembly 205. This is shown in FIG. 7.

In the upraised position, the weight of the empty pipe handling assembly 25 is transmitted through the ring 45*a*, spring 45 and bars 46 to the housing 21. In the engaged portion, the weight of the loaded pipe handling assembly 25 is transmitted from the load collar 41 directly to the drive shaft assembly 205.

Figure 9:
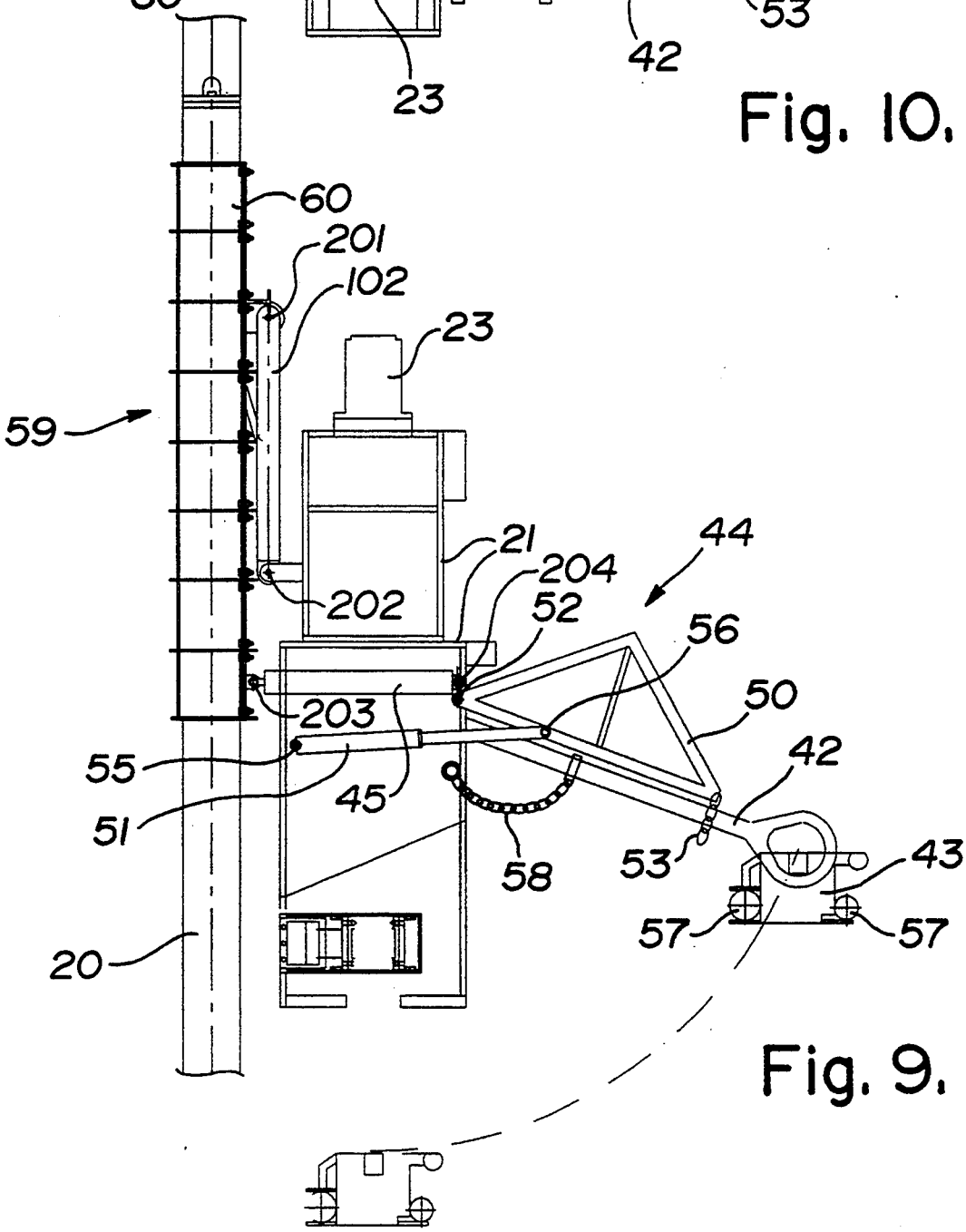
FIG. 9 is a side view of the top drive system with the pipe handling assembly in a tilted orientation.

Referring now to FIG. 9, the pipe handling assembly 25 is shown to be angularly rotatable or tiltable from a normally vertically downward orientation to a near horizontal position by the tilting sub-assembly 44. This tilting sub-assembly 44 comprises a pair of lift arms 50 pivotally connected at their upper ends with the housing 2 by hole and pin means 52. The lift arms 50 are also connected at their lower ends with the bales 42 by chains 53. Hydraulic cylinders 51 are pivotally connected at their inner ends by hole and pin means 55 with the housing 21 and at their outer ends by hole and pin means 56 with the lift arms 50. Extension of the hydraulic cylinders 51 can pivot the bales 42 upwardly and forwardly. This facilitates positioning the elevator 43 as required for pipe handling and enables setting the top drive unit 13 down on the rig floor 2.

The elevator 43 is conventional and has air powered actuators 57 to automate opening and closing functions. For safety reasons, the force developed by the air actuators 57 is insufficient to open the elevators 43 when loaded with a drill pipe.

The pipe handling assembly 25 provides improved pipe handling, being capable of tilting the elevator 43 closer to the derrickman, allowing him to avoid the dangerous reach-out over space to pull back, capture or deliver pipe stands thereto during racking-back and tripping operations. A tilt stop means 58 is provided to prevent over-rotation of the elevator 43 and accidental contact with the derrick structure 6. The tilt stop means 58 may be in the form of a limited length chain stop and may be temporarily disabled to allow full rotation when setting the top drive down.

Should a serious maintenance or breakdown situation occur, or if very heavy drill, casing, tripping or fishing operations are anticipated, the portable top drive unit 13 may be set aside and the rig 1 may revert to conventional operation in typically less than half an hour. With the tilt stop 58 disabled and the pipe handling assembly 25 fully tilted to nearly horizontal, the top drive unit 13 may be set down on any strong surface, such as the rig floor 2. The swivel 12 can be quickly unscrewed from the top drive 13, and the standard kelly may be reinstalled for re-implementation of the conventional rotary table and kelly operation.

A torque track 20 is mounted in the derrick 6 and extends vertically along the major part of the derrick's length. The track 20 is of box-section and is substantially rigid. It is spaced rearwardly from the wellbore 3. It is rigidly connected at its lower end to the base of the derrick 6 and is suspended from the top of the derrick by a twistable, flexible cable 79. The track 20 is therefore rigidly connected to the rig only at its lower end and is free to twist axially and deflect laterally.

The torque track 20 is connected with the housing 21 of the top drive unit 13 by an assembly comprising a torque bushing 59 and a linking means, specifically a torque frame 102.

The bushing 59 is tubular and box-like in section. It fits around and is slidable on the stationary track 20. Because of their box-like configurations, the bushing 59 rigidly engages the track 20 so that it cannot rotate thereon but will transmit reactive loads to it. Stated otherwise, the bushing 59 is rotationally rigid relative to the track 20.

The bushing 59 is internally faced with ultra high molecular weight plastic having a low coefficient of friction, so that it slides easily on the track 20. It has a longitudinal slot 61 on one side to permit it to move past the connection means with the derrick 6.

The torque frame 102 is a rigid, flat, elongate member, angularly disposed and pivotally connected at its ends by horizontal pin and hole means 201, 202 with the housing 21 and bushing 59. The frame 102 thus can pivot about horizontal axes, relative to the housing 21 and bushing 59, but it is restrained by the bushing from rotating relative to the track 20. Stated otherwise, the torque frame is rotationally rigid relative to the housing 21 and bushing 59.

The top drive unit 13 generates reactive side and torque loads when drilling. These loads are transmitted from the housing 21, through the frame 102 and bushing 59, to the track 20. The track 20 transmits the loads to the rig 1 through its rigid connection therewith.

The track 20, bushing 59 and frame 102 further cooperate to guide the top drive unit 13 as it travels in the derrick 6.

The elongate form, angular positioning and pivoting capability of the frame 102 enables the top drive unit 13 to be displaced forwardly, so that it may be positioned over the mousehole or laid down on the rig floor.

Figure 11:
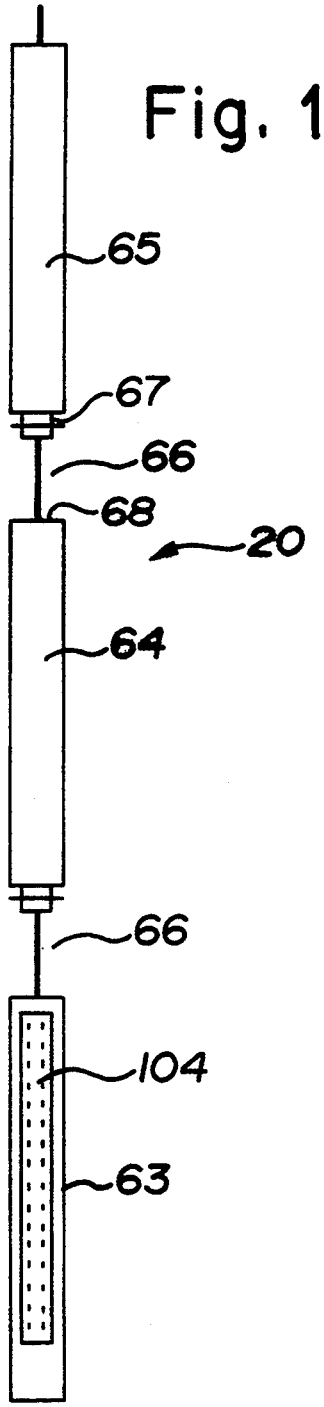
FIG. 11 is a side view of a three section torque track assembly in a loosely articulated arrangement.
Figure 12A:
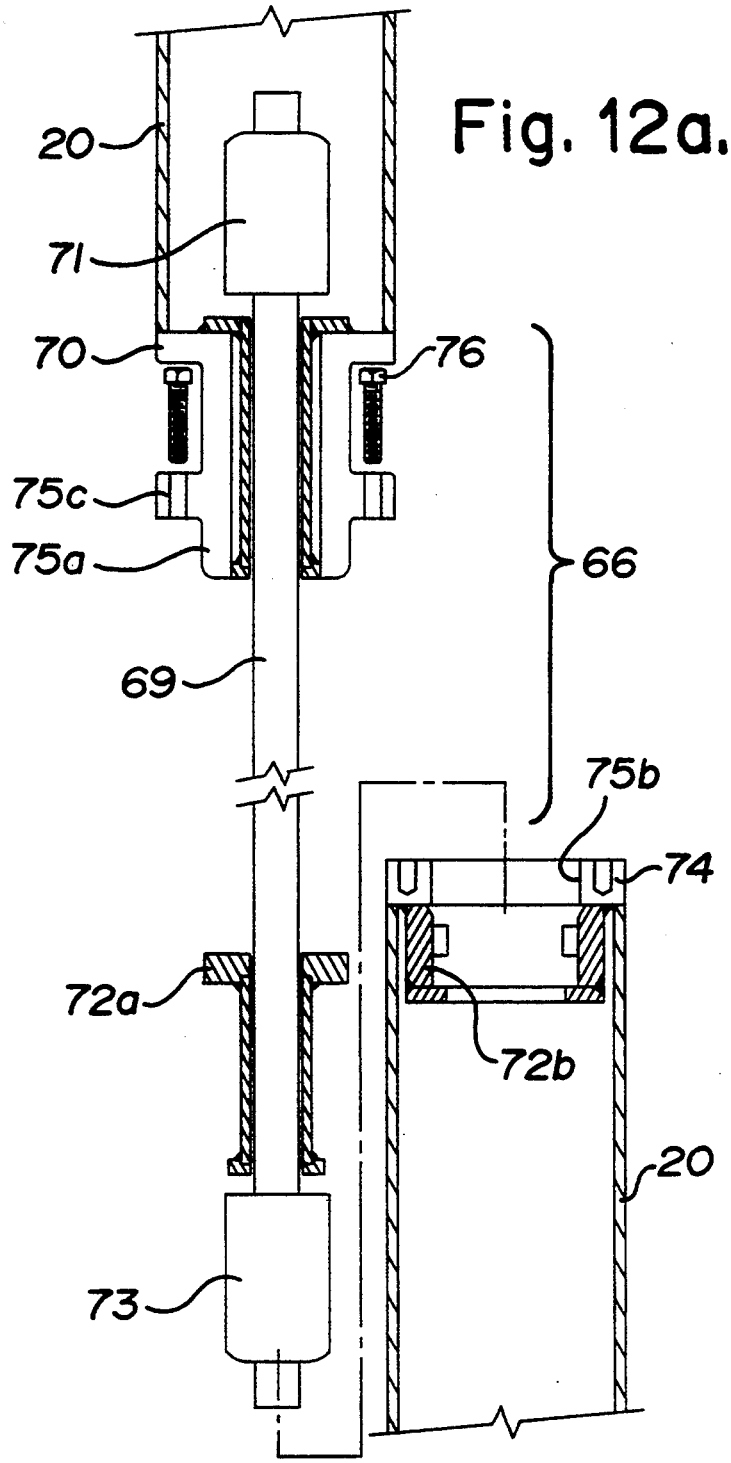
FIG. 12*a* is a front sectional view of a disassembled track section joint.
Figure 12B:
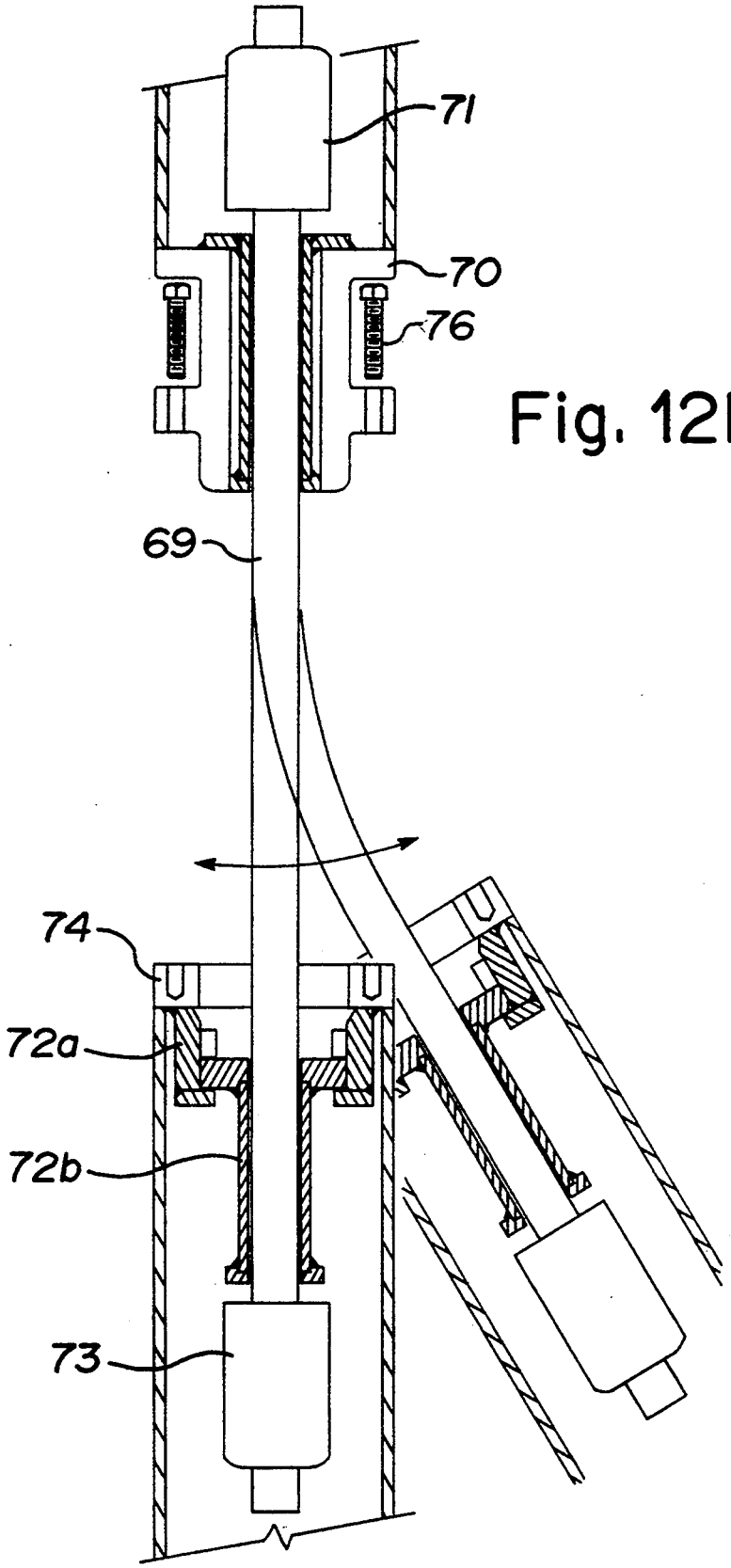
FIG. 12*b* is a front sectional view of the assembled track section joint of FIG. 12*a*, showing the joint in a disengaged condition, with a phantom view of an articulated positioning.
Figure 13:
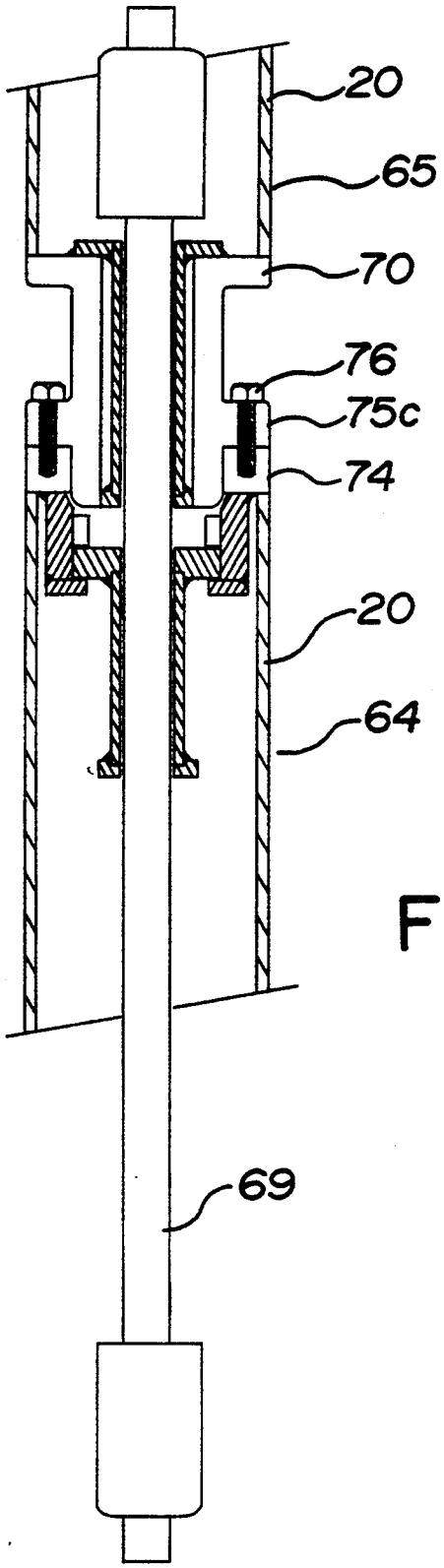
FIG. 13 is a front sectional view of the track section joint of FIG. 12*b* in its final rigidified, engaged form.

The torque track 20 is assembled from a plurality of sections of rectangular cross-section tubing, typically sized to standard oilfield drill pipe shipping lengths. In the particular embodiment shown in FIG. 11, three sections are depicted: a bottom section 63; a middle section 64; and a top section 65. The bottom section 63 is fitted with a plurality of frequently spaced mounting bolt holes 104 along its length to permit adapting to the particular derrick 6 being fitted with the track 20. The middle and top sections 64, 65 may be identical and have articulated assembly joints 66 mounted at each end, as seen in assembly FIGS. 12*a*, 12*b* and 13. The lower joint end of the top section 65 cooperates with the matching upper joint end of the middle section 64 to permit angular articulation during installation, yet when the sections 64, 65 are placed in collinear alignment they may be fitted together to form the linearly contiguous, unitary structural torque track 20. The upper end of a cable 69 is fitted loosely through a first closing plate 70 and is retained from slipping through with a button stop 71 at the cable end. The lower end of the cable 69 is similarly loosely fitted through a J-lock fitting 72*a* and is retained with a button stop 73. The ⅛ turn J-lock 72*a* adapts to disengagably connect the cable to a matching J-lock receiving fitting 72*b* on a second closing plate 74. The cable is of a suitable length that the track sections may articulate freely with a flexing of the cable, yet is short enough to retract within the track when the sections are drawn together. A protuberance 75*a* extending from the first closing plate 70 is adapted to fit into a matching opening 75*b* in the second closing plate 74. The protuberance engages the opening 75*b* until a bolting flange 75*c* contacts the second closing plate 74 thereby aligning and stabilizing the sections together. Locking means 76 such as bolts are employed to rigidly join the track sections 64, 65. The bottom section 63 is similarly joined to the middle section 64 to complete the torque track 20 assembly.

Figure 15:
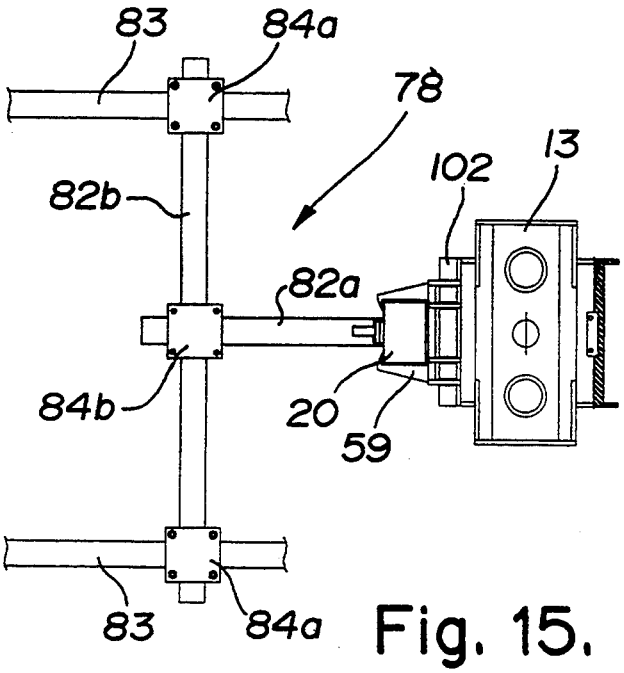
FIG. 15 is a top view of the torque track connection means and torque beam according to FIG. 14.
Figure 14:
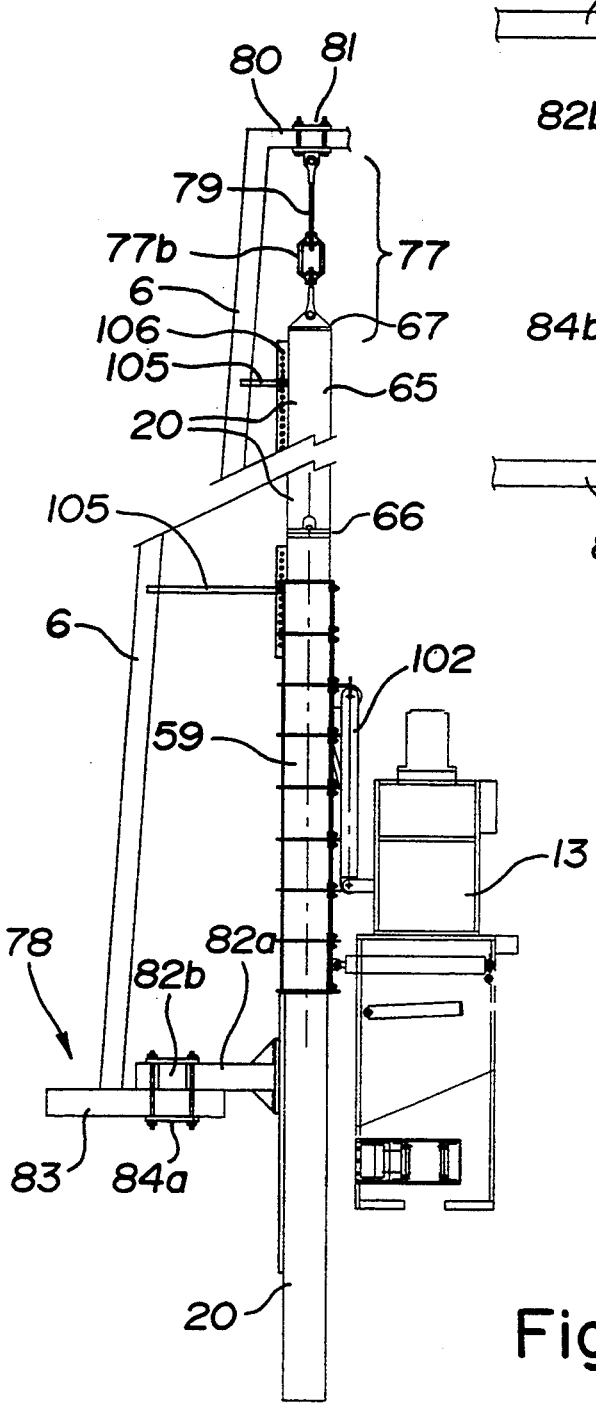
FIG. 14 is a side view of the top drive unit, torque bushing, torque track upper and lower connection means and torque beam.

Referring to FIGS. 14 and 15, the torque track 20 is secured to the derrick 6 with an upper and a lower connection means 77, 78. The upper connection means 77 comprises a cable 79 attaching the upper joint end of the top track section 65 to a suitable cross-brace 80 at the crown of the derrick. 6 with a clamping means 81. The upper connection means 77 includes a vertical adjusting means 77*b*, such as a turnbuckle, to provide limited vertical adjustment. The torque track 20 is suspended by this upper connection means 77 which is capable of stabilizing horizontal movement of the torque track and yet freely rotates when subjected to torque loading. The lower connection means 78 comprises a torque arm 82*a* connected to and projecting laterally from the torque track 20. The torque arm 82*a* may be connected using any of a plurality of bolting holes (not shown) formed along the track, to adapt to variable geometry of different derricks 6. A torque beam 82*b* is connected to the torque arm to connect to suitable bracing 83 on the derrick 6 near its robust base where reactive drilling torques may safely be absorbed. The torque track 20 is designed with sufficient torsional rigidity to transmit the full reactive drilling torque to the rigid lower connection means 78 and into the substructure of the drilling rig 1. The torque beam 82*b* is rigidly attached to the bracing 83 on the derrick 6 with a clamping means 84*a* which permits connections to be made without need for welding or other structural modifications to be made to the derrick 6. The torque arm is similarly rigidly attached to the torque beam with a clamping means 84*b*. The clamping means 84*a*, 84*b* permit adjustments to re-align the torque track 20 to the wellbore as required.

The mechanism that permits the torque track to absorb the reactive loads as substantially torque and to prevent side loading of the upper structure of the derrick is not immediately apparent.

Figure 22:
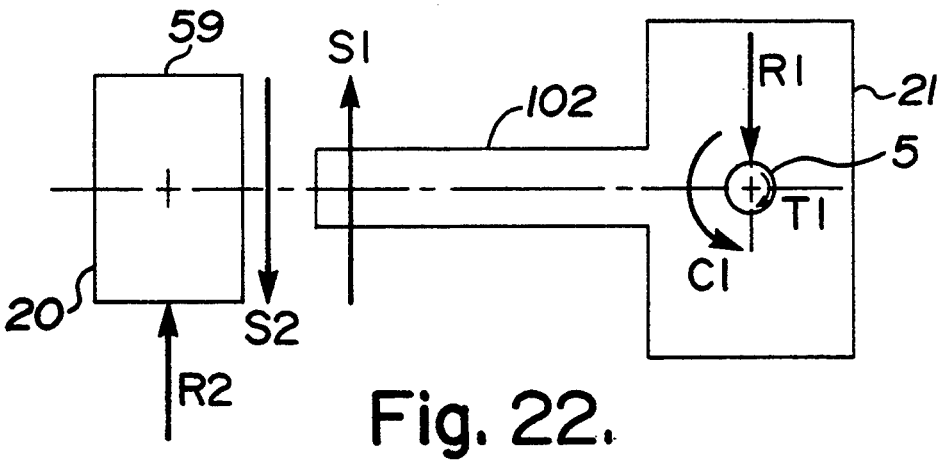
FIG. 22 is a free body force diagram of the top drive housing, pivoting link, and torque bushing demonstrating pure side loading forces to the torque bushing assuming an infinitely stiff drill string.

Referring to FIG. 22, a free body force diagram of the top drive housing 21, pivoting frame 102, and torque bushing 59 is shown. The top drive housing 21 is depicted as imparting a CW torque T1 to the drill string 5. The drill string resists the rotation and results in a CCW couple C1 into the frame. Assume for the moment, that the drill string is infinitely stiff. The frame acts as a moment arm which attempts to rotate around the drill string. The moment arm will impose purely side loading S2 into the torque bushing 59 and in turn into the torque track 20. An equal and opposite balancing load S1 then exists in the moment arm. To prevent free rotation of the rigid frame around the track due to the balancing force S1, a reactive side load R1 must exist on the drill string. Similarly, a reactive side load R2 must exist at the track. Should the assumption of the stiff drill string be true, high side loading of the torque track would result. High side loads could deflect the track significantly and impose loading to the top of the derrick which is contrary to the objective.

Figure 23:
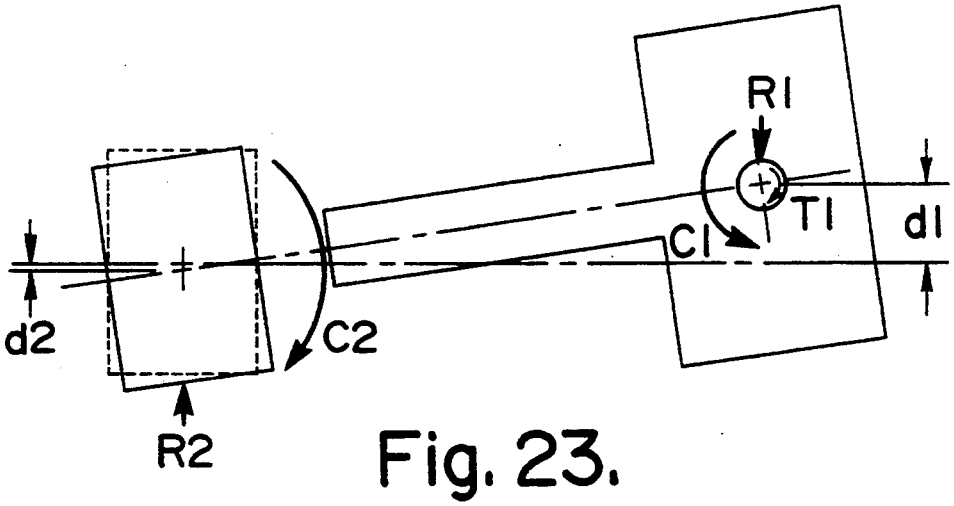
FIG. 23 is a free body force diagram according to FIG. 22 in a substantially torque loaded condition having recognised the flexible nature of the drill string.

Referring to FIG. 23, the drill string is found to be, not infinitely stiff, but is actually weak in side loading. If R1 is then essentially zero, the moment arm rotates essentially freely and deflects an amount d1, typically a couple of inches. The track is strong in side loading and deflects only a very small amount d2 to balance the small load R1.

The track must rotate with the moment arm or frame, being rigidly fixed thereto. The track has significant torsional rigidity and resists this rotation. This resistance manifests as a couple C2 and permits a small twist or rotation of the track. The reactive side load R2 on the track diminishes as the drill string deflects, the load being absorbed in the couple C2. The side loading S1 has thus been substantially converted to a reactive torque loading C2 into the track.

Several factors contribute to the drill string 5 being weak and permitting the conversion of side loads to torque loading. The drill string is normally long in length, has a relatively small moment of inertia and it extends down through a large rig-floor opening into the wellbore which offers little support. The drill string 5 is connected at its upper end to the top drive unit 13 which is connected to the travelling block 10. The travelling block is hung from the crown with cables 9 which are not normally capable of sustaining side loads.

Two extreme cases exist which interfere with the side-to-torque load conversion mechanism. When the top drive is positioned near the rig floor 2, and particularly when slips are engaged at the rotary table, the drill string 5 is stiffened and cannot deflect. The pivoting frame 102 acts as a moment arm and transfers pure side loading to the torque track 20. This extreme case is adequately compensated by the close proximity of the strong torque arm 82*a* and torque beam 82*b* connection, absorbing side loads without subjecting the upper part of the derrick to reactive loading. The second case occurs when the top drive is positioned at the top of the derrick 6. Theoretically, one could shorten the length of the cable 9 to zero, thus stiffening the drill string. This situation is highly unlikely to occur and in the worst case would result in reactive load sharing between the torque track 20 and the derrick 6.

Operations other than drilling place special load conditions on the torque track 20. Lifting of heavy loads from the V-door 101 can place unusual side loads on the torque track 20, deflecting it away from the derrick 6. Of particular concern is the rebound effect when the load is released, potentially permitting the torque track to strike the structure of the derrick, often located immediately adjacent the track. In the worst case, if the torque bushing 59 is moving at that instant, it can collide with the derrick 6, potentially damaging both the derrick and the bushing.

As shown in FIG. 14, it is preferable to install a steadying means such as turnbuckles 105, connected between the derrick and torque track at vertically spaced points. Bars 106 having a plurality of connecting sites are attached to the torque track 20. Connection of the turnbuckle 105 to each bar 106 is loose enough to permit reactive load movement but is sufficiently rigid to prevent contact of the torque bushing 59 with the derrick 6. Stated otherwise, the connection prevents the track from moving toward or away from the back of the derrick but the connection is loose enough to allow the track to move sideways and most importantly is loose enough that the connection cannot transmit any torque.

Figure 16:
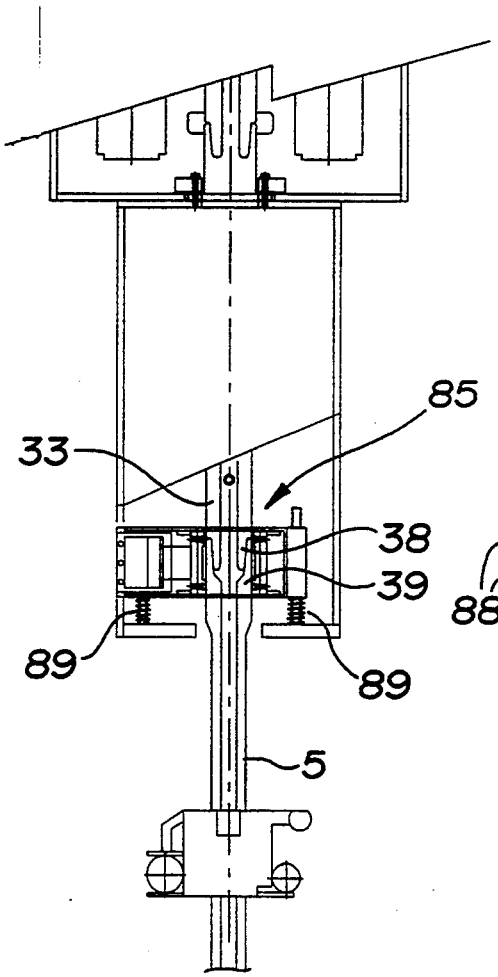
FIG. 16 is a partial side view of the top drive unit, detailing the backup wrench means sectioned through the drill string axis.
Figure 17:
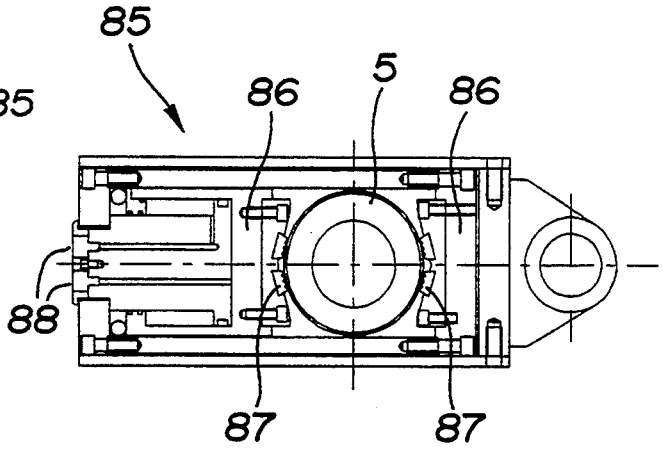
FIG. 17 is a top sectional view of the backup wrench, according to FIG. 16, shown in a gripping state of a drill joint.
Figure 19:
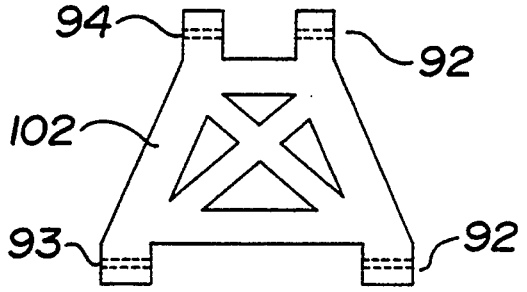
FIG. 19 is a top view of the pivot link frame of FIG. 18.
Figure 18:
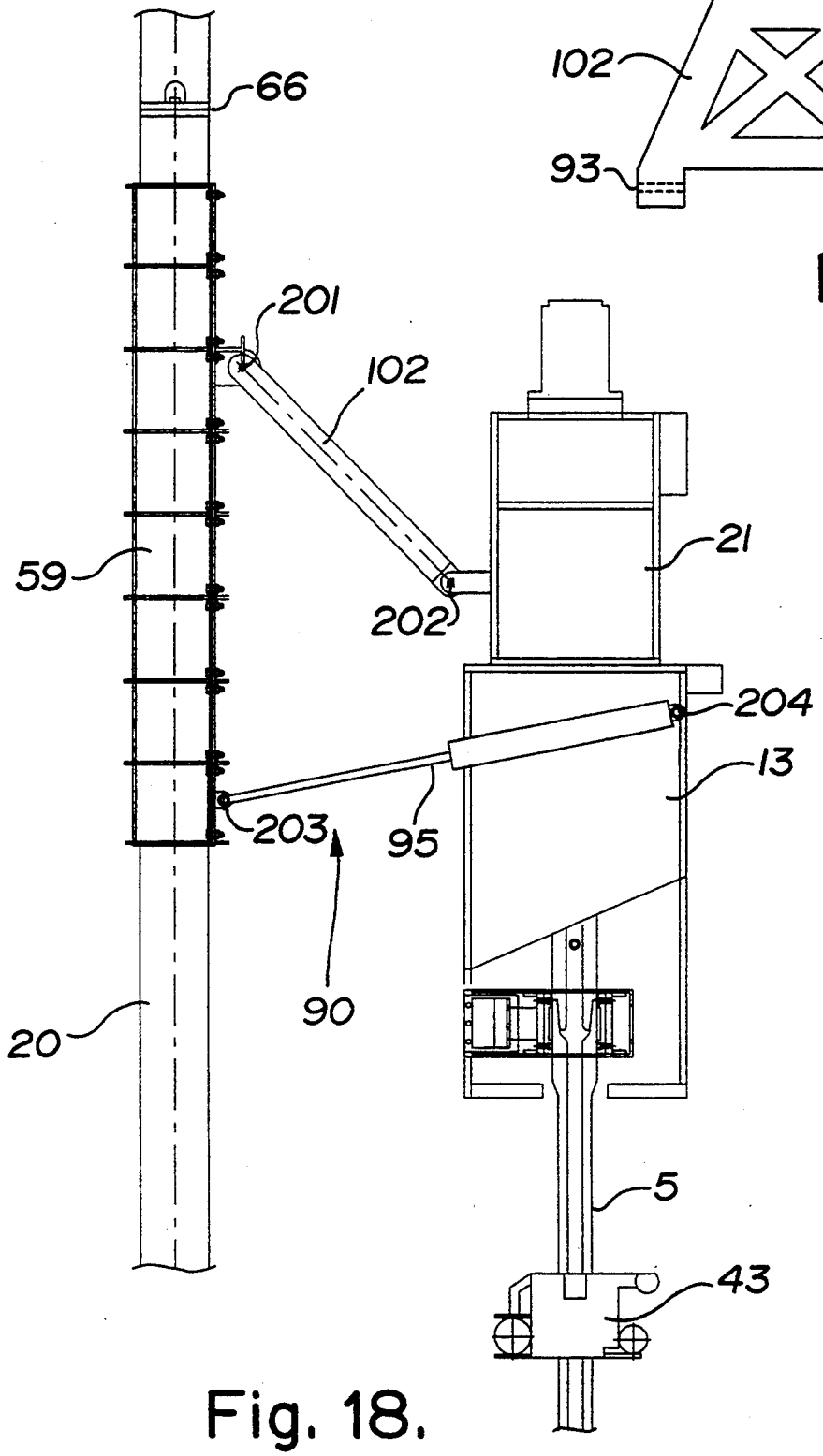
FIG. 18 is a side view of the top drive system in an extended orientation (pipe handling assembly omitted)

Referring to FIGS. 16 and 17, at an elevation near and below the lower end 38 of the saver sub 33, a backup wrench assembly 85 is provided comprising opposing rotation drill string tongs 86 having standard oilfield tong jaw dies 87. Individual hydraulic actuating means 88 are provided to cause the tong jaws to hold the drill pipe 5 stationary while the drive shaft 22 is appropriately rotated to connect or disconnect the saver sub joint 38, 39 thereto. The wrench assembly 85 makes it possible to make or break the tool joint at any position in the derrick. The wrench assembly 85 is secured to the lower portion of the top drive housing 21 with a spring mount means 89. When disengaging a drill pipe 5 from the saver sub 33, the wrench assembly is positioned to engage the top of the pipe. As the saver sub is screwed out of the drill pipe 5, the springs 89 deflect, permitting both the pipe 5 and the wrench assembly 85 to be moved down by the pitch action of the threads.

A hydraulic cylinder 95 is pivotally connected at its ends by horizontal pin and hole means 203, 204 with the torque bushing 59 and top drive housing 21. Extension of the cylinder 90 will shift the top drive unit 13 forwardly; the pivoting frame 102 accommodates this movement. The top drive unit 13 can thus be biased to an alternate position, such as over the mousehole 100.

Figure 20:
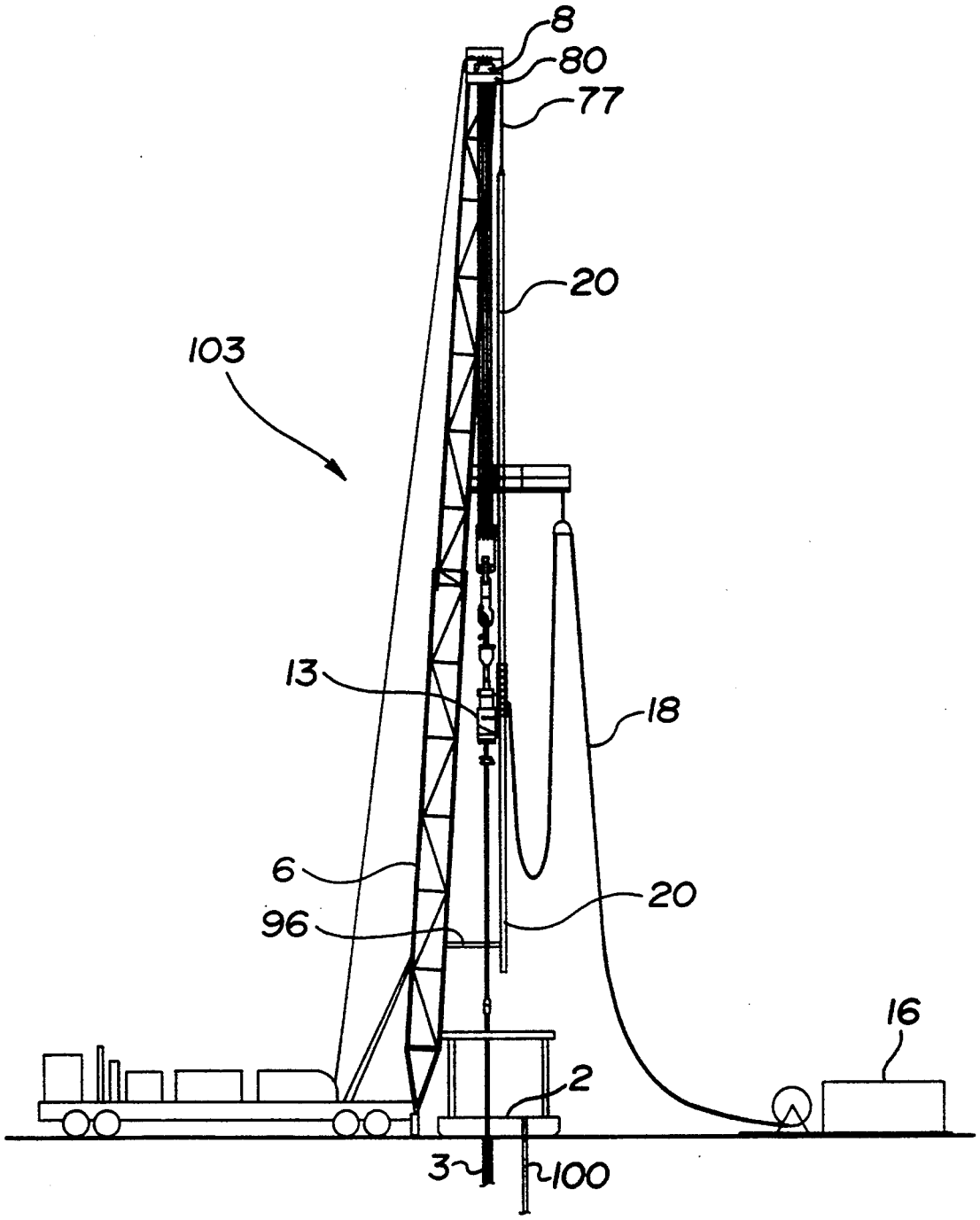
FIG. 20 is an alternate installation of the torque track on a portable drilling rig.
Figure 21:
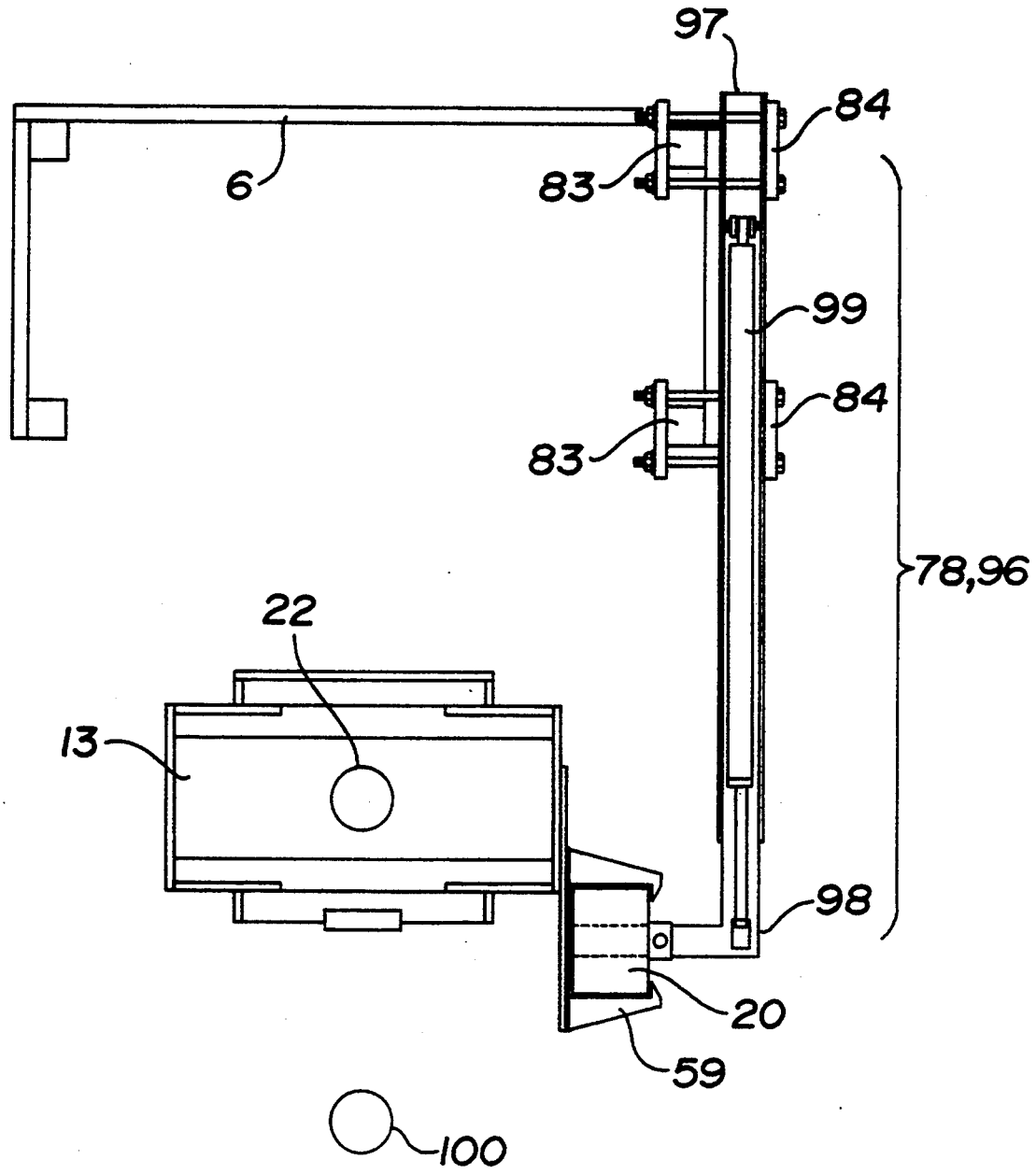
FIG. 21 is a 90° rotated top view of an alternate torque beam used in the installation according to FIG. 20.

It may not be feasible to locate the torque track 20 at the back of the derrick 6. This can occur in the case of a portable rig 103 having a leaning derrick 6, where an obstacle free path is not available from the rig floor 2 to the crown of the derrick (FIGS. 20 and 21). In this case, the torque track 20 may be installed at right angles from the wellbore 3 and mousehole 100 alignment. The torque track 20 is suspended from the crown brace 80 with the upper connection means 77 as previously described, but the lower connection means 78 is provided by a telescoping torque beam assembly 96, whereby the first end of the beam 97 is secured to the robust base of the derrick 6 with the clamping means 84 and the second end 98 is moveable with respect to the first and is pivotally connected to the torque track 20. An extending and retracting means 99 is provided to extend the second end 98 with respect to the first end, resulting in a pivoting of the entire track 20, from the crown bracing 80, thereby extending the top drive unit 13 from a position over the wellbore 3 to an alternate position such as over the mousehole 100.

With the "extend" feature, several advantages in pipe handling and efficiency are realized. The extend feature permits the mousehole, offset from the wellbore, to be drilled by the top drive. It is possible to make up drill pipe connections at the mousehole with the joint connection at the rig floor, at eye level. Stands of drill pipe can be made up over the mousehole, improving drilling efficiency. When drilling, the top drive may drill to the floor and, using a combination of extend and the tilt elevator, one can simultaneously pick up a new length of pipe from the V-door. The extend feature may also be used to further assist the derrickman in handling drill collars, as the bales and elevator can then bring the particularly heavy collars closer.

The embodiments of the invention in which an exclusive property or privilege is claimed are defined as follows:

1. A portable top drive assembly for use with a drilling rig having a base, said rig further having an upstanding derrick operatively aligned over a wellbore, said derrick supporting hoisting means, a swivel and a drill string extending into the wellbore, said top drive assembly comprising:

a top drive unit comprising a housing, a drive assembly supported by the housing, and a tubular drive shaft assembly extending vertically through the housing and being connected with the drive assembly for rotation thereby, said drive shaft assembly having upper and lower ends and being connected at its lower end with the drill string and at its upper end with the swivel for suspension from the derrick by the hoisting means;

the top drive unit housing being subjected to reactive side and torque loads when the drive shaft rotates the drill string; and apparatus for transmitting the reactive loads from the housing to the rig comprising a linearly extending, substantially rigid torque track extending vertically in the derrick along a major part of the derrick's length, said track having upper and lower ends, said track being parallel with and laterally offset from the wellbore, said track being formed of sections joined end to end, means for disengagably and rigidly connecting the track sections end to end, means for rigidly connecting the track at its lower end with the base of the rig so that reactive loads applied to the track are transmitted therethrough to the rig and so that the track is held upright in the derrick, the track otherwise being free of rigid connection with the derrick so that it can twist axially and deflect laterally relative to the derrick, a torque bushing rigidly engaging the track so that it can slide therealong but cannot rotate thereon, said bushing being operative to transmit reactive loads applied to it to the track, and linking means, connecting the housing and the bushing, for rigidly restraining the housing against rotation relative to the bushing and track and for transmitting reactive side and torque loads from the housing to the track.

2. The top drive assembly as set forth in claim 1:

wherein the linking means is angularly disposed and pivotally connected at its ends with the housing and bushing so that said linking means can pivot about horizontal axes to enable the top drive unit to be displaced laterally; and comprising linearly extendable means for displacing the top drive unit laterally.

3. The top drive assembly as set forth in claim 2:

wherein the linearly extendable means comprises cylinder means mounted between and pivotally connected to each of the housing and the bushing pivoting about horizontal axes.

4. The top drive assembly as set forth in claims 1, 2 and 3 comprising:

twistable, flexible cable means suspending the upper end of the track from the upper end of the derrick.

5. In a drilling rig having a base, said rig further having an upstanding derrick operatively aligned over a wellbore, said derrick supporting hoisting means, a swivel suspended from the hoisting means and a drill string extending into the wellbore, the improvement comprising:

a top drive unit ,comprising a housing, a drive assembly supported by the housing, said drive assembly comprising hydraulic motors and a gear assembly connected therewith, and a tubular drive shaft assembly extending vertically in the housing and being operatively connected with the gear assembly for rotation thereby, said drive shaft assembly having upper and lower ends and being connected at its lower end with the drill string and at its upper end with the swivel for suspension in the derrick by the hoisting means;

the top drive unit housing being subjected to reactive side and torque loads when the drive shaft rotates the drill string;

apparatus for transmitting the reactive loads from the housing to the rig comprising a linearly extending, substantially rigid torque track extending vertically in the derrick along a major part of the derrick's length, said track having upper and lower ends, said track being parallel with and laterally offset from the wellbore, said track being formed of sections joined end to end, means for disengagably and rigidly connecting the track sections end to end, means for rigidly connecting the track at its lower end with the base of the rig so that reactive loads applied to the track are transmitted therethrough to the rig and so that the track is held upright in the derrick, the track otherwise being free of rigid connection with the derrick so that it can twist axially and deflect laterally relative to the derrick, a torque bushing rigidly engaging the track so that it can slide therealong but cannot rotate thereon, said bushing being operative to transmit reactive loads applied to it to the track, and linking means, connecting the housing and the bushing, for rigidly restraining the housing against rotation relative to the bushing and track and for transmitting reactive side and torque loads from the housing to the track;

a portable independent power supply unit for driving the hydraulic motors with hydraulic fluid; and a bundle of hoses suspended from the derrick and operatively connecting the power supply unit and motors for conveying fluid therebetween.

6. The improvement as set forth in claim 5 comprising:

a load collar carried by the drive shaft assembly;

a pair of bales pivotally suspended from the load collar;

an elevator carried by the bales; and linearly extendable means, pivotally connected with the housing and bales, for pivoting the bales upwardly a generally horizontal position.

7. The improvement as set forth in claim 5:

wherein the linking means is angularly disposed and pivotally connected at its ends with the housing and bushing so that said linking means can pivot about horizontal axes to enable the top drive unit to be displaced laterally; and comprising linearly extendable means for displacing the top drive unit laterally.

8. The improvement as set forth in claim 7:

wherein the linearly extendable means comprises cylinder means mounted between and pivotally connected to each of the housing and the bushing for rotation about horizontal axes.

9. The improvement as set forth in claims 5, 7 or 8 comprising:

twistable, flexible cable means suspending the upper end of the track from the upper end of the derrick.

* * * * *